United States Patent [19]

Morse

[11] Patent Number: 5,075,646

[45] Date of Patent: Dec. 24, 1991

[54] COMPENSATED MIXED DIELECTRIC OVERLAY COUPLER

[75] Inventor: Alfred W. Morse, Ellicott City, Md.

[73] Assignee: Westinghouse Electric Corp., Pittsburgh, Pa.

[21] Appl. No.: 600,651

[22] Filed: Oct. 22, 1990

[51] Int. Cl.[5] ..... H01P 5/18

[52] U.S. Cl. ..... 333/116; 333/161

[58] Field of Search ..... 333/116

[56] References Cited

U.S. PATENT DOCUMENTS 4,394,630 7/1983 Wayne et al. ..... 333/116

FOREIGN PATENT DOCUMENTS 2658364 6/1978 Fed. Rep. of Germany ..... 333/116

*Primary Examiner*—Paul Gensler

*Attorney, Agent, or Firm*—W. G. Sutcliff

[57] ABSTRACT

A loaded overlay coupler with capacitive stubs slows down the even mode velocity more than odd mode velocity. The quarter wavelength of the coupler cancels impedance caused by the stubs so that directivity is enhanced and impedance mismatch is minimized.

17 Claims, 3 Drawing Sheets

COMPENSATED MIXED DIELECTRIC OVERLAY COUPLER

BACKGROUND OF THE INVENTION

1. Field of the Invention

This invention relates a microwave coupler. In particular, the invention relates to a compensated mixed dielectric overlay coupler which corrects mismatched mode velocities.

2. Description of the Prior Art

A suspended stripline is a convenient medium to use for microwave components which need the low loss properties of an air dielectric stripline, but with the convenience of fabrication possible with printed circuit conductors. FIG. 1 shows the configuration of a known suspended stripline transmission line 10. In the usual case, the substrate 12, which is a relatively thin low dielectric material of thickness t carries stripline conductor 14. A ground plane 16 is spaced by a distance d from the substrate 12. The spacing d is large compared to the thickness t. In the case illustrated, the transmission line represented by the conductor 14 and the ground plane 16 has essentially the same impedance, loss, and wave velocity as if the conductor were embedded in pure air. Likewise, the substrate 12 may be suspended between strips of "mostly air" honeycomb material, not shown, and formed into a lightweight bonded unit which retains most of the useful properties of an air dielectric stripline.

A known overlay coupler 20 shown in FIG. 2 employs opposed striplines 22 and is a common arrangement using pure stripline forms. The optimum length of the coupled lines 22 (into the page) is $\lambda/4$ at the design center frequency. The coupler directivity is theoretically perfect over a wide bandwidth. Most commercial hybrid couplers are manufactured in this manner, usually with air forming the dielectric between, above and below the strips 22.

FIGS. 3A and 3B show a known overlay coupler 24 employing striplines 26 on a suspended substrate 28 operating in respective even and odd modes. This type of coupler has not previously been considered advantageous or particularly useful because the dielectric constant of the substrate 28 between the striplines 26 is different from the dielectric constant of the air in the spaces 29 above and below the striplines 26 resulting in different wave velocities in the even and odd modes. The overlay coupler 24 does not work well because the odd mode transmission medium (substrate 28) has a different effective dielectric constant from the effective even mode medium (air space 29).

FIGS. 3A and 3B illustrate why the even and odd modes operation of the suspended stripline overlay coupler 24 have different effective dielectric constants, and therefore different wave velocities. In the even mode, FIG. 3A, the striplines 26 are the same polarity. The electric field E is confined in the spaces 29 between the strips 26 and ground planes 16. There is essentially no field between the strips 26 in the dielectric substrate 28, and the effective even mode wave propagation is very similar to an air stripline, with the strip width W and a thickness S as shown.

In the odd mode, FIG. 3B, the striplines are opposite polarity and the field E is concentrated between the strips in the dielectric substrate 28. In fact, there is a virtual ground $G_v$ which can be constructed by symmetry between the strips 26, and the effective odd mode wave propagation is essentially that of a microstrip with a dielectric substrate of thickness S/2. Because the even and odd modes operate in media having vastly different effective dielectric constants, the propagation velocities are also different and it is not possible to choose a coupler length which is a quarter wave of both modes. As a result, no matter what length is chosen, either or both the even or odd modes effective lengths will not be $\lambda/4$, and the result is a coupler having poor directivity and impedance match.

SUMMARY OF THE INVENTION

The present invention is designed to overcome the shortcomings and limitations of the described prior arrangements. In particular, a new technique has been devised to correct the mismatch of mode velocities of the even and odd modes to the load.

The invention comprises an overlay coupler being loaded with capacitive stubs in such a manner as to slow down the even mode velocity more than odd mode velocity. Further, the invention takes advantage of the quarter wavelength of the coupler to cancel VSWRs caused by the stubs.

In a particular embodiment, a microwave coupler comprises a dielectric substrate having opposed sides. First and second striplines are disposed on opposite sides of the substrate. Each stripline includes coupling portions, input and output portions extending from the respective ends of the coupling portion, and capacitive stub portions extending from the input and output portions. The coupling portions of the striplines are arranged on the substrate in confronting relationship.

DESCRIPTION OF THE PREFERRED EMBODIMENT

Figure 4:
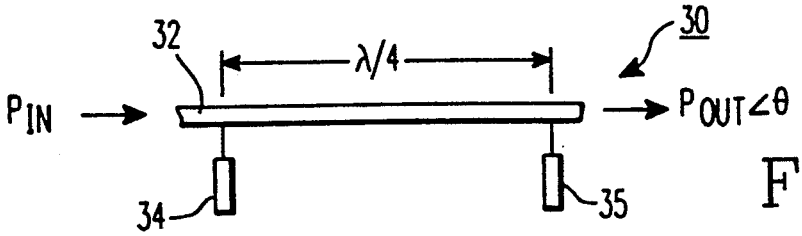
FIG. 4 illustrates a loaded line phase shifter.

FIG. 4 illustrates a technique employed in the present invention for slowing wave velocity in a loaded line phase shifter 30 formed of a stripline 32 and a pair of capacitive stubs 34–35 extending from the stripline 32. The capacitive stubs 34–35 load the stripline 32 with a reactance which causes the signal on the transmission line to be phase shifted. The phase shift can be considered to be an effective slowing of the wave velocity. While one capacitive stub would be sufficient to load the stripline 32 in the arrangement illustrated the capacitive stubs 34–35 are separated by a distance λ/4, where throughout the disclosure λ is the wavelength of the frequency of interest, e.g. the design or operating frequency. In such an arrangement, the effective phase shift, as determined by the characteristics of the capacitive stubs 34–35, may be tailored to be the same as a single lumped element. However, impedance mismatch caused by the stubs 34–35 separated by a quarter wavelength on the stripline, tends to cancel thereby providing good VSWR characteristics.

Figure 5:
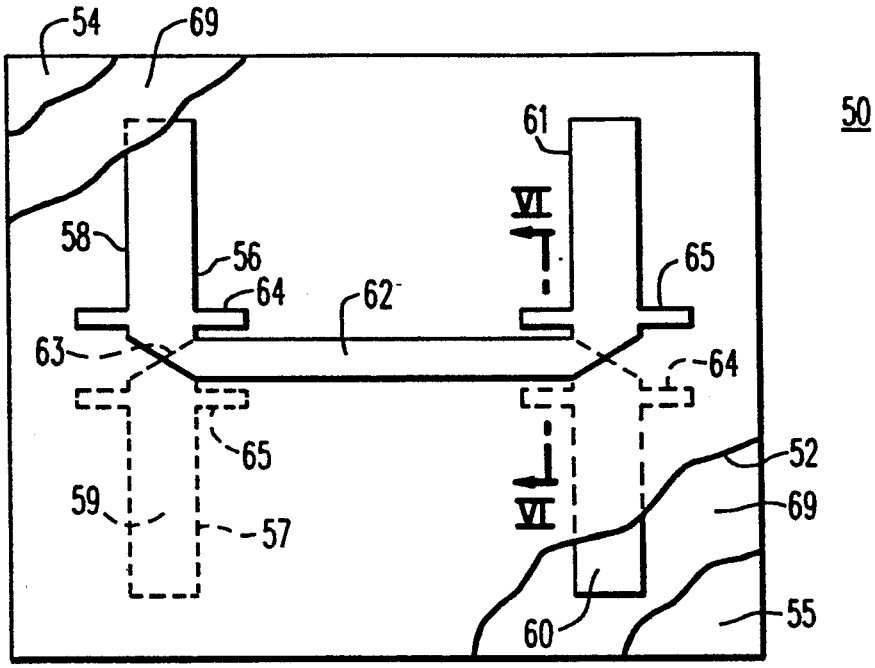
FIG. 5 is a fragmented plan view of a mixed dielectric overlay coupler in accordance with the present invention with an optional honeycomb dielectric support.
Figure 6A:
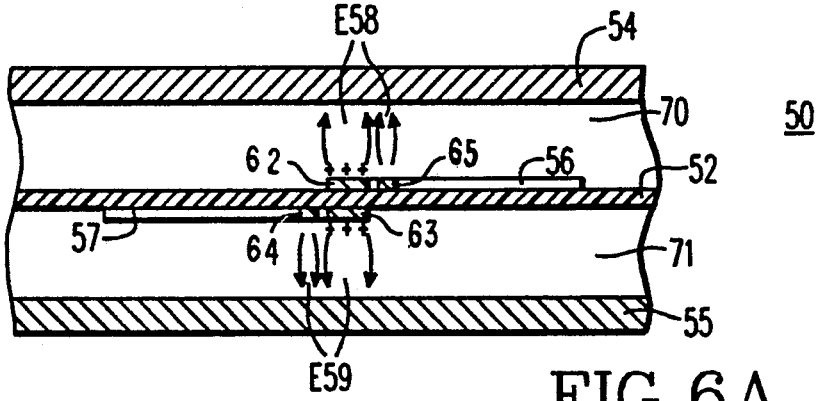
FIGS. 6A and 6B are schematic side illustrations of the coupler taken along line VI—VI of FIG. 4 with the striplines operating in respective even and odd modes without the optional honeycomb dielectric.
Figure 6B:
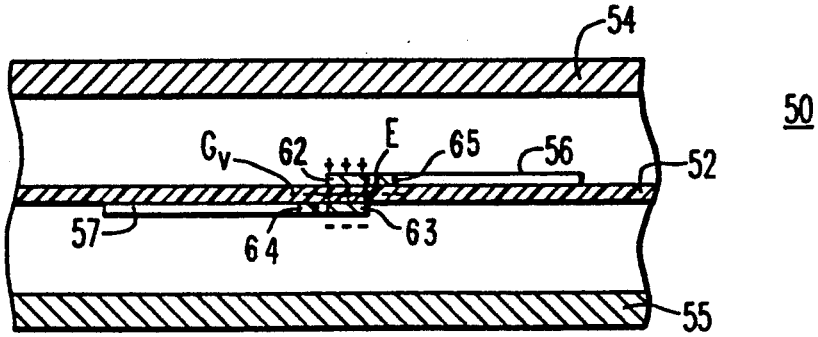

An exemplary embodiment of the present invention is illustrated in FIGS. 5 and 6A–6B. In FIG. 5 a mixed dielectric and air overlay microwave coupler 50 is illustrated. The arrangement comprises a dielectric substrate 52 and a pair of opposing ground planes 54–55 in spaced relationship on opposite sides of the substrate 52. A pair of striplines 56–57 are disposed on the opposite sides of the substrate 52 as illustrated. Each stripline is formed of serially interconnected terminal portions or ports 58–59 and 60–61 and intermediate coupling portions 62–63. The coupling portions of each of the striplines 56–57 are in confronting relationship on opposite sides of the substrate 52 as shown. The terminal portions 58–59 and 60–61 are offset so as not to be on confronting relationship on opposite sides of the substrate 52. Capacitive compensation stubs 64–65 forming part of the striplines 56–57, as shown, extend from opposite sides of the ports 58–59 and 60–61 to load each stripline 56–57 and to provide a phase shift. Optional honeycomb dielectric 69 such as a foamed dielectric or other cellular material, shown only in FIG. 5, may be provided in the spaces between the substrate 52 and ground planes 54–55. As noted above, the coupling section 62–63 of each stripline 56–57 is a selected length L which is selected to be a quarter wavelength of the frequency of interest.

For purposes of discussion, port 58 is sometimes hereafter referred to as the input port; port 59 is the coupled port; port 60 is the output port and port 61 is the isolated port. If a signal is applied to the input port 58 on stripline 56 a portion of the signal is carried by the stripline 56 through the coupler section 62 to output port 60 and a portion of the signal is coupled to the stripline 59 by field interactions between the coupled portions 62–63 and is carried to the coupled port 59. Reflected power from the output port 60 is coupled to the isolated port by symmetry. The input power appearing at the output port 60 and the coupled port 59 are split in accordance with the coupling ratio. For example, in a 3 dB coupler one half the power is at the coupled port 59 and one half the power is at the output port 60. Other selectable ratios are also possible.

When the signals carried by both striplines 62–63 are the same polarity, for example, positive (even mode) an arrangement such as illustrated in FIG. 6A occurs. Each stripline 58 and 59 sets up a corresponding electric field E56–E58 which extends to the respective ground plane 54–55 across the gap 70–71. The capacitive stubs 64–65 being electrically activated establish a part of each electric field E58–E59 between the striplines 58–59 and the ground planes 54–55. The net capacitive effect of the capacitive stubs 64–65 therefore provides a phase shift to the even mode signal carried by the striplines.

As illustrated in FIG. 6B, when the signals carried by the stripline are opposite polarities (odd mode), that is, when stripline 58 is positive with respect to stripline 59 or vice-versa, an electric field E is established between the striplines 58–59 establishing the virtual ground $G_v$ in the substrate 52. In such an arrangement, the capacitive stubs 64–65 although electrically activated, have very little influence on the overall capacitance of the circuit. This occurs because the stubs 64–65 are not in confronting relationship and accordingly provide relatively little reactance to the circuit. Accordingly, a different phase shift in the signal is established in the odd mode than in the even mode.

Figure 1:
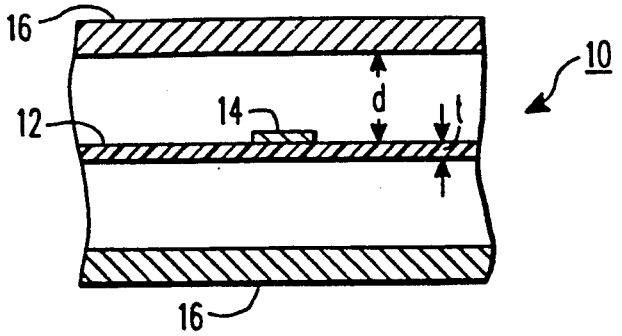
FIG. 1 PRIOR ART
FIG. 1 is a schematic end view of a known suspended stripline.
Figure 2:
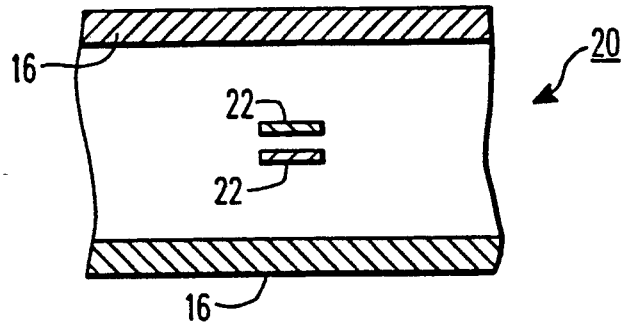
FIG. 2 PRIOR ART
FIG. 2 is a schematic end view of a known arrangement employing overlay coupled lines in air medium.
Figure 3A:
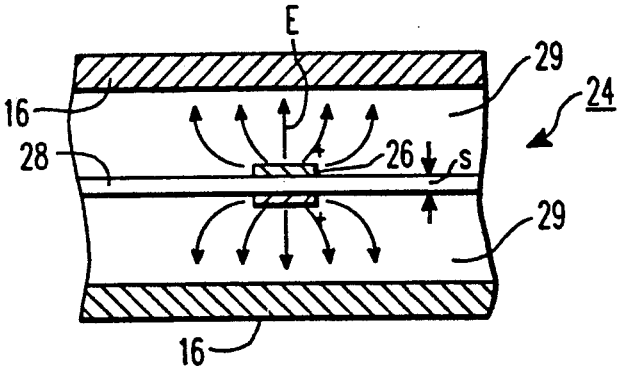
FIG. 3A is an end view of a known suspended stripline mixed dielectric coupler operating in the even mode.
Figure 3B:
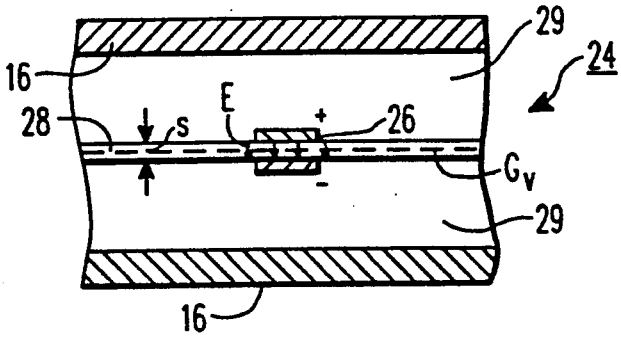
FIG. 3B is an end view of the arrangement of FIG. 3A operating in the odd mode.

In the arrangement illustrated, the previously poor coupler performance obtained with the suspended stripline overlay couplers 24 (FIGS. 3A–3B) due to the even mode having a faster wave velocity in air than the odd mode in the substrate has been corrected. The capacitive reactance created by the capacitive stubs 64–65 is effective only in the even mode thereby slowing down even mode wave propagation so that it will be the same as the odd mode propagation.

A feature of the present invention is that the capacitive stubs 64–65 are located on all the ports 58–61 as shown. The capacitance of each stub 64–65 is selected so that the total impedance is sufficient to cause the wave propagation in both modes to be the same, i.e. to slow down the even mode propagation so that it is the same as the odd mode propagation. The stubs are separated by a length λ/4 in the coupled portions 62–63. Accordingly, the capacitive reactance established by the capacitive stubs 64 is the inverse of and tends to cancel the reactance of the stubs 65 such that the striplines appear to have unchanged impedance. In other words the capacitive reactance of stubs 64 on the input side translates into an inductive reactance of the stub 65 on the output side which cancel at the frequency of interest yet provide phase shift to the wave. The present invention leaves the line impedance virtually unchanged yet provides the desired phase shift. In a transmission line, typically the ideal impedance is 50 ohm.

A further feature of the present invention is that directivity, or the ability of the various ports to selectively isolate signals or carry desirable signals is improved. For example, in the arrangement illustrated, the input port 58 is designed to carry the signal to the coupling portions 62–63 whereby the signal splits evenly between the output port 60 and the coupled port 59. The isolated port 61 is isolated and has no output signal. Further, any spurious signal appearing at the output port 60 or the coupled port 59 is isolated from the input port 58.

Good directivity occurs when power at the isolated port is not seen by the input port. The directivity of the present invention is graphically illustrated in FIG. 7A which is a plot of signal strength versus frequency. The dotted line represents signal strength between input port 58 and isolated port 61 without compensation. The signal is virtually unchanged at the center frequency. Thus, signals pass between ports 58 and 61 virtually unimpeded. The solid lines illustrate the effect of the invention at the center frequency fc. In this case, the power of the port 61 signal as seen by the input port 58 is cut off at fc, thereby illustrating improved directivity between the ports 58 and 61. The directivity characteristic between coupled port 59 and output port 60 is essentially the same as shown in FIG. 7A.

Good matching results in little or no reflections. FIG. 7B illustrates, in dotted line, the impedance characteristic at input port 58 as a function of signal strength with poor matching. The reflected signal strength is desirable which is minimum at the center frequency. The characteristic impedance of the exemplary embodiment is illustrated in solid lines. The characteristics near design frequency are virtually perfect with reflected signal strength below −30 dB at the center frequency fc.

Figure 7A:
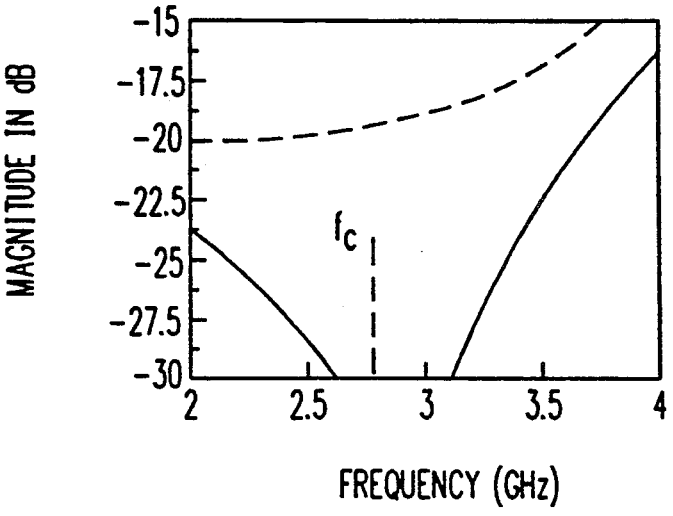
FIGS. 7A–7B are graphical representations of signal strength versus frequency illustrative of directivity and impedance mismatch.
Figure 7B:
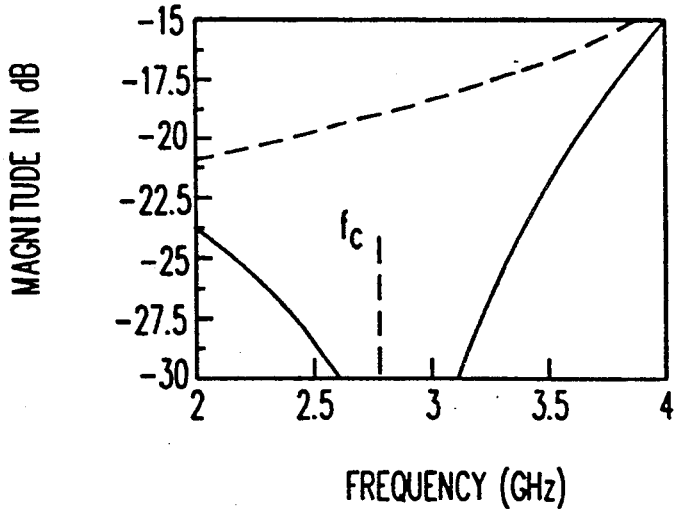

Accordingly, while the directivity illustrated in FIG. 7A is appropriately enhanced by the present invention, the desirable characteristic impedance shown in FIG. 7B is virtually unaffected. Thus, the invention provides for good directivity without creating an undesirable impedance mismatch in the device.

In a preferred embodiment of the invention the substrate 52 may be formed of a fluorocarbon sold under the trademark TEFLON having a dielectric constant $E_r$ of about 2.17. The optional honeycomb dielectric 59 has a dielectric constant $E_r$ of about 1.1.

While there has been described what at present is believed to be the preferred embodiments of the present invention, it will be apparent to those skilled in the art the various changes and notifications may made therein without departing from the invention, and is intended in the appended claims to cover all such modifications and changes that come within true spirit and scope of the invention.

What is claimed is:

1. A microwave coupler for coupling odd and even mode signals comprising:

a ground plane;

a dielectric substrate having opposite sides being in spaced relation with the ground plane;

first and second striplines disposed on opposite sides of the substrate, each of said striplines including an elongated coupling portion in confronting relationship forming a coupling region therebetween and having end portions, and input and output terminal portions extending from the respective end portions of each coupling portion; and capacitive stub portions separated by at least a quarter wavelength of the odd mode signal extending symmetrically from the terminal portions of each stripline in a transverse direction, said capacitive stub portions being spaced from the coupling portions and being effective to affect even mode signals only.

2. The microwave coupler of claim 1 further comprising conductive ground plane means in spaced relationship with the coupling portion of each stripline.

3. The microwave coupler of claim 1 wherein the dielectric substrate has a first electromagnetic wave transmission characteristic and the space between each coupling portion and ground plane has a second different electromagnetic wave transmission characteristic such that even signal microwave signals of the same polarity carried by the striplines travel at a propagation speed which is different from odd mode microwave signals of opposite polarity carried by the striplines.

4. The apparatus of claim 1 wherein the space between the substrate and the ground planes has a dielectric constant of about 1.1.

5. The microwave coupler of claim 1 wherein the dielectric substrate has a relatively low impedance transmission characteristic and the capacitive stub portions have a correspondingly greater effect on even mode signals than odd mode signals.

6. The apparatus of claim 1 wherein the substrate is formed of TEFLON having a dielectric constant of about 2.17.

7. The apparatus according to claim 1 wherein the coupler is adapted to carry a microwave signal of a selected frequency and the coupling portion has a length which is about one quarter wavelength of the microwave signal at the selected frequency.

8. The apparatus according to claim 1 wherein the capacitive stub portion on the input and output represent inverse impedances so that the phase of the microwave signal is delayed by the stub portions without affecting the impedance between the input and the output of the coupler.

9. A microwave coupler having an input end and an output end for coupling input microwave energy in odd and even polarity modes substantially through different media comprising a planar substrate having opposite sides and a characteristic impedance to microwave energy;

a conductive ground plane surrounding the substrate in spaced relationship, the space having a characteristic impedance to microwave energy;

a first stripline disposed on one side of the substrate and a second stripline disposed on an opposite side of the substrate, the first stripline has respective serially interconnected input, coupling and output portions and the second stripline having respective serially interconnected input, coupling and output portions, the coupling portion of the first and second striplines each having a length of at least a quarter wavelength of the microwave energy in the odd polarity mode and being in confronting relationship on opposite sides of the substrate forming a broad side coupling region therebetween;

impedance means symmetrically connected in a transverse direction to the input and output portions of each stripline and being spaced from the coupling region for introducing a phase shift in the microwave energy in even modes.

10. The microwave coupler of claim 9 wherein the impedance characteristic of the impedance means has a relatively greater effect on the phase shift of the microwave signal when the signals are the same polarity than when the signals are of opposite polarity.

11. The microwave coupler of claim 9 wherein the space between the coupling portion and the ground plane is atmosphere.

12. The microwave coupler of claim 9 wherein the substrate is dielectric having an impedance characteristic $E_r$ of about 2.1.

13. The apparatus of claim 9 wherein the impedance means comprises symmetrical capacitive stubs extending from the input and output portions of each of the striplines for establishing a relatively high capacitive impedance between the capacitive stubs and the ground plane when the microwave signals carried by the striplines are the same polarity and relatively low capacitive impedance when the signals are opposite polarities; the confronting portions lie in parallel planes in parallel axial alignment and the input and output portions of the first stripline extend away from the interconnected coupling portion and the input and output portions of the second stripline.

14. The apparatus of claim 13 wherein each coupling portion has opposite ends serially coupled to the respective input and output portions and the capacitive stubs are spaced from the ends of the coupling portions.

15. The apparatus of claim 9 wherein the input and output portions of the first and second striplines lie in parallel axial alignment with each other and extend transversely away therefrom.

16. The apparatus of claim 15 wherein the input and output portions are perpendicular to the striplines.

17. The apparatus of claim 16 wherein the input and output portions of the first stripline extend in a direction opposite of the input and output portions of the second stripline.

* * * * *